US007815848B2

(12) United States Patent
Crum et al.

(10) Patent No.: US 7,815,848 B2
(45) Date of Patent: Oct. 19, 2010

(54) CORROSION RESISTANT ALLOY AND COMPONENTS MADE THEREFROM

(75) Inventors: James Roy Crum, Ona, WV (US); Nathan Charles Eisinger, Huntington, WV (US); Stephen Mark Gosnay, Ona, WV (US); Gaylord Darrell Smith, Huntington, WV (US)

(73) Assignee: Huntington Alloys Corporation, Huntington, WV (US)

( * ) Notice: Subject to any disclaimer, the term of this patent is extended or adjusted under 35 U.S.C. 154(b) by 245 days.

(21) Appl. No.: 11/788,931

(22) Filed: Apr. 23, 2007

(65) Prior Publication Data

US 2007/0258844 A1 Nov. 8, 2007

Related U.S. Application Data

(60) Provisional application No. 60/798,565, filed on May 8, 2006.

(51) Int. Cl.
*C22C 38/44* (2006.01)
*C22C 38/50* (2006.01)
*C22C 30/00* (2006.01)

(52) U.S. Cl. ..... 420/53; 420/586.1; 420/584.1; 420/66

(58) Field of Classification Search ..... 420/43, 420/53, 59, 65, 586.1, 584.1, 66, 68
See application file for complete search history.

(56) References Cited

U.S. PATENT DOCUMENTS 3,362,813 A 1/1968 Ziolkowski
4,248,629 A 2/1981 Pons et al.
4,358,511 A 11/1982 Smith, Jr. et al.
4,560,408 A 12/1985 Wilhelmsson
4,784,831 A 11/1988 Mankins et al.
4,837,108 A 6/1989 Kimura et al.
4,999,159 A 3/1991 Uematsu et al.
5,021,215 A * 6/1991 Sawaragi et al. ..... 420/584.1
5,160,389 A 11/1992 Akiyama et al.
5,194,221 A 3/1993 Culling
5,378,427 A 1/1995 Otsuka et al.
5,614,149 A 3/1997 Abe et al.
5,779,972 A 7/1998 Noda et al.
5,783,143 A 7/1998 Handa et al.
5,827,377 A 10/1998 Crum et al.
5,830,408 A 11/1998 Azuma et al.
6,060,180 A 5/2000 Ishitsuka et al.
6,146,582 A 11/2000 Linden
6,171,547 B1 * 1/2001 Sagara et al. ..... 420/49

(Continued)

FOREIGN PATENT DOCUMENTS

EP 0 155 011 A2 9/1985

(Continued)

*Primary Examiner*—Deborah Yee
(74) *Attorney, Agent, or Firm*—The Webb Law Firm

(57) ABSTRACT

A corrosion resistant alloy is provided which includes, in percent by weight: (a) 16 to 24% Ni; (b) 18 to 26% Cr; (c) 1.5 to 3.5% Mo; (d) 0.5 to 1.5% Si; (e) 0.001 to 1.5% Nb; (f) 0.0005 to 0.5% Zr; (g) 0.01 to 0.6% N; (h) 0.001 to 0.2% Al; (j) less than 0.2% Ti; and (k) less than 1% Mn, trace impurities, and the balance Fe. Articles, such as flexible automotive exhaust couplings, including the present alloys are also provided.

40 Claims, 12 Drawing Sheets

U.S. PATENT DOCUMENTS

| | | | | |
|---|---|---|---|---|
| 6,290,905 | B1 | 9/2001 | Watanabe et al. | |
| 6,352,670 | B1 | 3/2002 | Rakowski | |
| 6,391,254 | B1 | 5/2002 | Ono | |
| 6,685,881 | B2 | 2/2004 | Okabe et al. | |
| 6,866,816 | B2 | 3/2005 | Liang et al. | |
| 6,939,415 | B2 * | 9/2005 | Iseda et al. | 148/325 |
| 2003/0231976 | A1 | 12/2003 | Iseda | |
| 2004/0120843 | A1 | 6/2004 | Crum et al. | |
| 2005/0045251 | A1 | 3/2005 | Nishiyama et al. | |

FOREIGN PATENT DOCUMENTS

| | | | | |
|---|---|---|---|---|
| EP | 0708184 | | * | 4/1996 |
| EP | 0 838 533 | A1 | | 4/1998 |
| GB | 2 318 802 | A | | 5/1998 |
| JP | 362007832 | | * | 1/1987 |
| JP | 05-195127 | A | | 8/1993 |
| JP | 07-138708 | | * | 5/1995 |
| JP | 08-013099 | A | | 1/1996 |
| JP | 2001-107196 | A | | 4/2001 |
| JP | 2001-262283 | | * | 9/2001 |
| WO | WO 03/060174 | A | | 7/2003 |
| WO | WO 2004/072316 | A1 | | 8/2004 |

* cited by examiner

Fig. 2: INCOLOY® 864 alloy after 1800°F anneal, 500X, Br Etch

Fig. 3: Sample 7 (high Zr, N, Nb, Al) after 1800°F anneal, 500X, Br Etch

Fig. 4: INCOLOY® 864 alloy after 2000°F anneal, 500X, Br Etch

Fig. 5: Sample 7 (high Zr, N, Nb, Al) after 2000°F anneal, 500X, Br Etch

Effect of nitrogen on Strength, 1800 deg. F Anneal

Effect of Nitrogen on Strength, 2000F Anneal

Figure 10
Effect of Aluminum on Ductility, 2000F Anneal
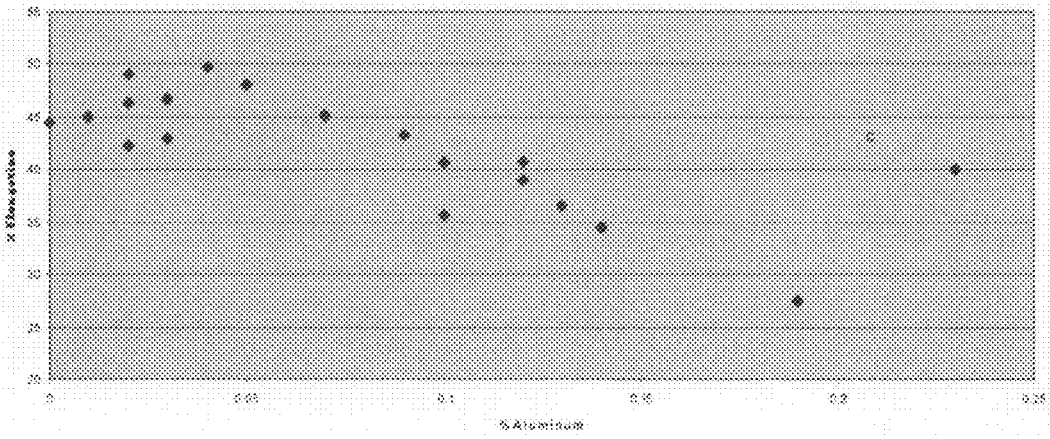
FIG. 11
Figure 11
Effect of Ni / Cr Ratio on Ductility, 2000F Anneal
Samples containing N >0.07% and Al <0.05%
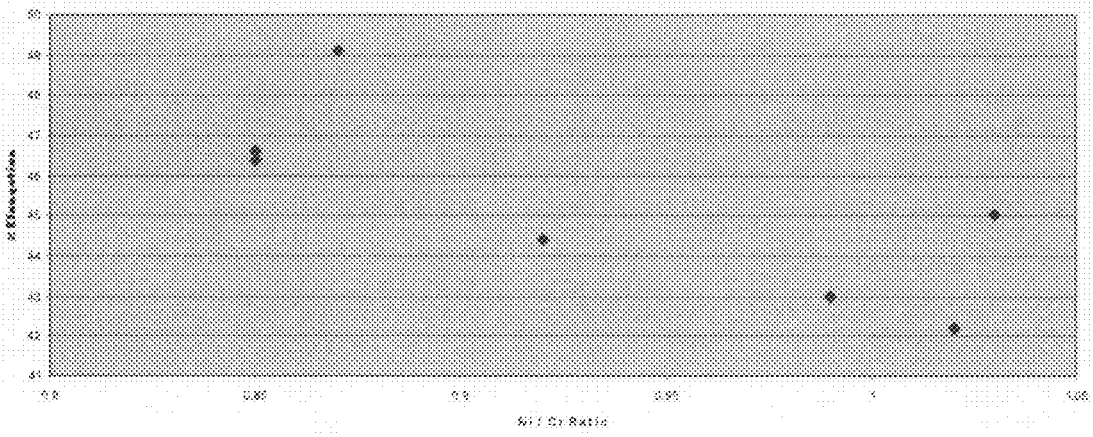

Effect of Al and N on Ductility, 2000F Anneal
% Elongation Results Shown

Effect of Al on Grain Size, 2000F Anneal

Effect of Al on Grain Size After Simulated Brazing Thermal Cycle

Effect of Al + Zr + Nb on Grain Size After a Simulated Brazing Thermal Cycle
Samples containing less than 0.05% Al Effect of N and Al on ASTM Grain Size After a Simulated Brazing Thermal Cycle High Temperature Fatigue Test Results – Longitudinal Strain Controlled Oxidation Resistance of Commercial and Exp. Compositions 0.062" thickness, 1093°C (2000°F) - Cycled Weekly
Mass Change, mg/cm2
0
-50
-100
-150
-200
-250
-300
0
200
400
600
800
1000
1200
1400
Exposure Time, Hrs
HW0959DD -CU15A (0.04% Nb)
Sample 6 (0.03% Nb)
Sample 7 (0.58% Nb)
310SS (1100°C)
Sample 10 (0.05% Nb)
Sample 13 (0.004% Nb, 25% Cr)

CORROSION RESISTANT ALLOY AND COMPONENTS MADE THEREFROM

CROSS-REFERENCE TO RELATED APPLICATION

This application claims priority to U.S. Provisional Application No. 60/798,565 filed May 8, 2006, entitled "Corrosion Resistant Alloy and Components Made Therefrom".

BACKGROUND OF THE INVENTION

1. Field of the Invention

This invention relates to iron-base alloys in general and, more particularly, to a corrosion resistant alloy which can be useful for flexible products, such as automotive exhaust components.

2. Description of Related Art

Operating requirements for automotive flexible exhaust couplings are becoming increasingly severe. Higher operating temperatures and more stringent emission requirements, along with extended warranties and government demands for increased gas mileage, are rendering conventional coupling alloys marginally acceptable or, more often, unacceptable for a growing number of engine platforms. Requirements for longer life demand corresponding improvements in fatigue and corrosion resistance properties of alloys.

In an automotive exhaust system, a bellows assembly is inserted between the exhaust manifold and the exhaust pipe. Due to the exacting requirements of modern catalytic exhaust systems, the bellows must permit the flexible routing of exhaust system components while simultaneously preventing oxygen ingress to the oxygen sensor.

Currently, bellows are comprised of a welded two- or three-ply metal tubular sheet which is partially corrugated to form a flexible bellows arrangement. Two- and three-ply designs typically utilize stainless steel (321 or 316Ti) inner layers. The outer ply can be made from INCONEL® 625 alloy or INCOLOY® 864 alloy. INCONEL® 625 and INCOLOY® 864 Ni—Cr alloys are commercially available from Special Metals Corporation of Huntington, W. Va. The thickness of each of the plys can range from about 0.006 inches (0.15 mm) to about 0.01 inches (0.25 mm). In some designs, the bellows are protected by an inner and outer mesh covering of stainless steel (304) wire braid.

The road salt applied for deicing purposes eventually degrades the bellows. Analysis has shown that the stainless steel bellows corrode due to hot salt corrosion and chloride stress corrosion cracking. In some applications in which the bellows is located close to the exhaust manifold, high temperature fatigue is a concern. The requisite flexible nature of the bellows ultimately leads to the corrosive- or fatigue-induced demise of the stainless steel. For this reason, manufacturers have been specifying INCONEL® 625 or INCOLOY® 864 alloys as the protective outer ply since it resists salt corrosion and fatigue.

Due to the competitive nature of the automotive industry, there is a demand for a flexible alloy that is cost effective, superior in corrosion resistance to stainless steel, and fatigue resistant. In other automotive applications, such as diesel exhaust gas coolers, good grain size control during high temperature brazing operations and good post braze fatigue properties are desired.

SUMMARY OF THE INVENTION

In some embodiments, the present invention provides a corrosion resistant alloy consisting essentially of, in percent by weight:

(a) 16 to 24% Ni;
(b) 18 to 26% Cr;
(c) 1.5 to 3.5% Mo;
(d) 0.5 to 1.5% Si;
(e) 0.001 to 1.5% Nb;
(f) 0.0005 to 0.5% Zr;
(g) 0.01 to 0.6% N;
(h) less 0.001 to 0.2% Al;
(j) less than 0.2% Ti; and
(k) less than 1% Mn, trace impurities, and the balance Fe.

In other embodiments, the present invention provides a corrosion resistant alloy, wherein the alloy consists essentially of, in percent by weight:

(a) 20 to 24% Ni;
(b) 20 to 24% Cr;
(c) 2 to 3% Mo;
(d) 0.5 to 1.2% Si;
(e) 0.001 to 0.5% Nb;
(f) 0.0005 to 0.2% Zr;
(g) 0.1 to 0.3% N;
(h) 0.005 to 0.02% C;
(i) 0.001 to 0.1% Al;
(j) zero to 0.05% Ti; and
(k) less than 0.9% Mn, trace impurities, and the balance Fe.

In other embodiments, the present invention provides a corrosion resistant alloy, wherein the alloy consists essentially of, in percent by weight:

(a) 20% Ni;
(b) 24% Cr;
(c) 2.2% Mo;
(d) 1.2% Si;
(e) 0.02% Nb;
(f) 0.001% Zr;
(g) 0.25% N;
(h) 0.01% C;
(i) 0.01% Al;
(j) 0.01% Ti; and
(k) less than 0.5% Mn, trace impurities, and the balance Fe.

Articles of manufacture, such as automotive flexible exhaust couplings, comprising any of the above alloys also are provided.

BRIEF DESCRIPTION OF THE DRAWINGS

The present invention will best be understood from the following description of specific embodiments when read in connection with the accompanying drawings:

FIG. 10 is a graph showing the effect of concentration of aluminum on ductility for test samples annealed at 2000° F.;

FIG. 11 is a graph showing the effect of nickel to chromium ratio on ductility for test samples annealed at 2000° F.;

DETAILED DESCRIPTION OF THE INVENTION

Figure 1:
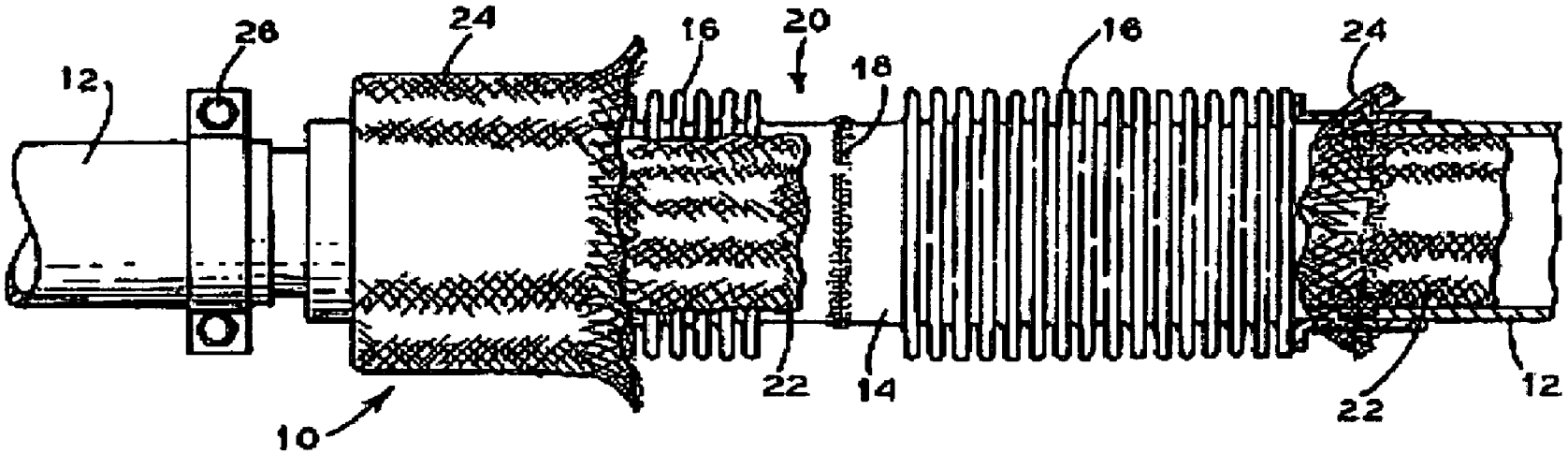
FIG. 1 is a side elevational view of an automotive exhaust system bellows, partially cut away to show components of the bellows.

Other than in the operating examples, or where otherwise indicated, all numbers expressing quantities of ingredients, thermal conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

Also, it should be understood that any numerical range recited herein is intended to include all sub-ranges subsumed therein. For example, a range of "1 to 10" is intended to include all sub-ranges between and including the recited minimum value of 1 and the recited maximum value of 10, that is, having a minimum value equal to or greater than 1 and a maximum value of equal to or less than 10.

The alloys of the present invention can be less expensive than conventional alloys and can be used to form articles having good corrosion resistance, ductility, fatigue resistance, strength and grain size control for brazing purposes. The alloys of the present invention can provide good resistance to corrosion mechanisms such as stress corrosion cracking, pitting, hot salt attack, oxidation, and road salt under both low temperature aqueous and high temperature conditions.

In some embodiments, the present invention provides corrosion resistant alloys consisting essentially of, in percent by weight:

(a) 16 to 24% Ni;
(b) 18 to 26% Cr;
(c) 1.5 to 3.5% Mo;
(d) 0.5 to 1.5% Si;
(e) 0.001 to 1.5% Nb;
(f) 0.0005 to 0.5% Zr;
(g) 0.01 to 0.6% N;
(h) less 0.001 to 0.2% Al;
(j) less than 0.2% Ti; and
(k) less than 1% Mn, trace impurities, and the balance Fe (iron), on a basis of total weight of components of the alloy. In some embodiments, the alloys of the present invention consist of the above components.

In some embodiments, the amount of Ni ranges from 18 to 25 weight percent. In other embodiments, the amount of Ni ranges from 20 to 25 weight percent. In other embodiments, the amount of Ni is 20 weight percent.

In some embodiments, the amount of Cr ranges from 20 to 24 weight percent. In other embodiments, the amount of Cr is 24 weight percent.

In some embodiments, the ratio of Ni to Cr is up to 0.8:1.

In some embodiments, the amount of Mo ranges from 2 to 3 weight percent. In other embodiments, the amount of Mo is 2.2 weight percent.

In some embodiments, the amount of Si ranges from 0.5 to 1.2 weight percent. In other embodiments, the amount of Si is 1.2 weight percent.

In some embodiments, the amount of Nb ranges from 0.001 to 0.5 weight percent. In other embodiments, the amount of Nb is 0.02 weight percent.

In some embodiments, the amount of Zr ranges from 0.001 to 0.2 weight percent. In other embodiments, the amount of Zr is 0.001 weight percent.

In some embodiments, the amount of N ranges from 0.1 to 0.3 weight percent. In other embodiments, the amount of N is 0.25 weight percent.

In some embodiments, the amount of C ranges from 0.005 to 0.02 weight percent. In other embodiments, the amount of C is 0.01 weight percent.

In some embodiments, the amount of Al ranges from 0.005 to 0.1 weight percent. In other embodiments, the amount of Al is 0.01 weight percent.

In some embodiments, the amount of Ti ranges from zero to 0.02 weight percent. In other embodiments, the amount of Ti is 0.01 weight percent.

In some embodiments, the alloy comprises less than 0.9 weight percent of Mn. In other embodiments, the alloy comprises less than 0.8 weight percent of Mn. In other embodiments, the alloy comprises less than 0.5 weight percent of Mn.

In some embodiments, the alloy is essentially free of rare earth metals, such as lanthanum and/or cerium. In other embodiments, the alloy comprises less than 0.05 weight percent of rare earth metals. In other embodiments, the alloy comprises less than 0.03 weight percent of rare earth metals. In other embodiments, the alloy is free of rare earth metals.

The alloy is essentially free of trace impurities such as sulfur and phosphorus. For example, the alloy contains less than 0.01 weight percent of each trace impurity.

In some embodiments, the present invention provides corrosion resistant alloys wherein the weight percentage of aluminum is at least 0.08% and nitrogen is at least 0.1%.

In some embodiments, the present invention provides corrosion resistant alloys wherein the weight percentage of aluminum is less than 0.5% and the sum of the weight percentages of aluminum, zirconium and niobium is at least 0.06%.

In some embodiments, the present invention provides corrosion resistant alloys, wherein the alloy consists essentially of, in percent by weight:

(a) 20 to 24% Ni;
(b) 20 to 24% Cr;
(c) 2 to 3% Mo;
(d) 0.5 to 1.2% Si;
(e) 0.001 to 0.5% Nb;
(f) 0.0005 to 0.2% Zr;
(g) 0.1 to 0.3% N;
(h) 0.005 to 0.02% C;
(i) 0.001 to 0.1% Al;
(j) zero to 0.05% Ti; and
(k) less than 0.9% Mn, trace impurities, and the balance Fe. In some embodiments, the alloys of the present invention consist of the above components.

In other embodiments, the present invention provides corrosion resistant alloys, wherein the alloy consists essentially of, in percent by weight:

(a) 20% Ni;
(b) 24% Cr;
(c) 2.2% Mo;
(d) 1.2% Si;
(e) 0.02% Nb;
(f) 0.001% Zr;
(g) 0.25% N;
(h) 0.01% C;
(i) 0.01% Al;
(j) 0.01% Ti; and
(k) less than 0.5% Mn, trace impurities, and the balance Fe. In some embodiments, the alloys of the present invention consist of the above components.

Articles of manufacture can be prepared from any of the alloys of the present invention described above. The alloys of the present invention can be cold or hot worked, annealed, welded, brazed, etc. as desired, to form articles.

Corrosion resistant alloys of the present invention are capable of use under severe operating conditions and can be useful for forming, for example, flexible exhaust couplings, bellows, wire braids, heater sheathes, heat exchangers, coolers, tubes, manifolds, high temperature jet engine honeycomb seals and various recuperator applications. The alloys of the present invention can provide high temperature fatigue resistance and oxidation resistance, which are desirable for specialized applications such as flexible coupling, engineering and exhaust manifold applications. Also, alloys of the present invention can provide grain size control during high temperature brazing operations and good post braze fatigue properties, which are useful in automotive applications such as coolers. Alloys of the present invention also can provide low cost, oxidation and fatigue resistance useful for jet engine honeycomb seals, external components and ducting.

The present invention first will be discussed generally in the context of use in bellows for an automotive exhaust system. One skilled in the art would understand that the alloys of the present invention can also be useful for forming components in applications in which corrosion, flexibility and fatigue resistance are desirable attributes.

Referring now to FIG. 1, there is shown an automotive exhaust system bellows 10. The bellows 10 is situated on the exhaust line 12 between the exhaust manifold of an engine (not shown) and the muffler (not shown). The bellows 10 is designed to enable the exhaust pipe to be easily routed away from the engine while preventing the entry of oxygen into the catalytic converter. A conventional connector 26 is shown.

Typical bellows 10 are constructed from a tubular welded multi-ply sandwich (generally two or three layers) 14 of stainless steel and/or alloy. The alloys of the present invention can be used for any or all of these layers, for example the outer third layer. Each ply is generally about 0.01 inch (0.25 mm) thick. A portion of the alloy tube 14 is formed into flexible bellows section 16. Two bellows sections 16 are welded together at intersection 18 to form the bellows body 20. An internal mesh 22 made from stainless steel wire braid (0.015 inch [0.38 mm] diameter) is longitudinally disposed along the interior of the body 20 to protect the interior of the bellows 10 from the corrosive effects of exhaust gas. In FIG. 1, right side, a portion of the mesh 22 is pulled away and pushed back into the exhaust line 12 to display the internal body 20. The mesh 22 can be formed from an alloy of the present invention, if desired.

Similarly, an external mesh 24 is longitudinally disposed about the exterior of the bellow body 20 to protect the bellows 10 from mechanical damage. The mesh 24 is displayed partially cut and pulled away. The mesh 24 can be formed from an alloy of the present invention, if desired.

Studies have shown that the position of the bellows 10 vis-à-vis the engine is critical with respect to corrosion. A bellows 10 located close to the engine runs hotter than a bellows 10 installed further downstream. The temperature gradients appear to affect intergranular sensitization. A relatively hotter unit made from 321 stainless experienced a corrosive attack rate of 140 mils per year in a standard intergranular sensitization test. A relatively cooler unit situated further downstream from the engine and made from 321 stainless demonstrated a corrosion rate less than 24 mils per year.

In general usage, sections of the outer stainless steel braid 24 and the outermost stainless steel ply exhibit varying degrees of corrosive attack. Apparently, the chlorides found in road salt and exhaust gas respectively act to cause transgranular stress corrosion cracking and corrosion fatigue cracking.

As with the placement of the bellows 10, the internal mesh 22 runs hotter due to intimate contact with the exhaust gas and experiences intergranular corrosion. The relatively cooler external mesh 24 experiences pitting and stress corrosion cracking.

Engine manufacturers are seeking lower cost alternatives to multi-ply flexible stainless/alloy combinations. Accordingly, the instant alloy, which has good corrosion resistance, flexibility, strength and fatigue resistance properties, is an attractive alternative.

For bellows 10 construction, one or two plies of the instant alloy may be cold worked into a tubular bellows shape, braided with the instant alloy and conveniently installed anywhere along the exhaust stream.

In some embodiments, the alloys of the present invention have a fatigue life at 1000° F. of 500,000 cycles, at total strain range of 0.005, as measured according to ASTM Method E 606-92 (98) under the following conditions: longitudinal strain control, Extensometer length 0.375 inches, temperature of 1000° F. (538° C.), strain ratio R=−1.0, at a frequency of 0.5 Hz and triangle waveform using a closed loop servo-controlled hydraulic system of 20,000 lbs capacity.

In some embodiments, the alloys of the present invention resists stress corrosion cracking failure in boiling 45% magnesium chloride held at a constant boiling temperature of 155.0±1.0° C. for a period of 24 hours or more as measured according to ASTM Method G36-94 (2000) using samples prepared according to ASTM Method G30-97 (2003). The U-bend specimen is a rectangular strip which is bent 180° around a predetermined radius and maintained in this constant strain condition during the stress-corrosion test.

In some embodiments, the alloys of the present invention have an annealed yield strength of greater than 40 Ksi (for example 45 Ksi) and a minimum elongation of greater than 34% measured at a temperature of 25° C., according to ASTM Method E 8-04.

In some embodiments, the alloys of the present invention have an annealed yield strength of greater than 50 Ksi (for example 55 Ksi) and a minimum elongation of greater than 45% measured at a temperature of 25° C., according to ASTM Method E 8-04.

In some embodiments, the alloys of the present invention have an average ASTM grain size number of greater than 5 measured according to ASTM Method E112-96 (2004) after applying a simulated brazing cycle thermal treatment at 2200° F. (1204° C.) for 20 min, air cooled, then 2000° F. (1093° C.) for 3 hrs, and air cooled.

Illustrating the invention are the following examples which, however, are not to be considered as limiting the invention to their details. Unless otherwise indicated, all parts and percentages in the following examples, as well as throughout the specification, are by weight.

EXAMPLES

The following examples show the results of physical property testing for strength, ductility, grain size, oxidation and stress corrosion cracking resistance for several alloys of the present invention.

Fifty pound (22.7 kg) air melted laboratory alloys of the present invention were hot rolled at 2100° F. (1149° C.) to 0.250 inch (0.635 cm) plate, surface ground, cold rolled to 0.062 inch (0.157 cm) strip. Test samples were annealed at either 1800° F. (982° C.) or 2000° F. (1093° C.) for 5 min and air cooled. Test compositions are shown in Table 1 below.

TABLE 1

Chemical Composition of Alloys Tested

| Sample Heat No. | C | Mn | Fe | S | Si | Cu | Ni | Cr | Al | Ti | Mg | Mo | Nb | N | O | Zr |
|---|---|---|---|---|---|---|---|---|---|---|---|---|---|---|---|---|
| 1 | 0.012 | 0.8 | 50.1 | 0.002 | 1.1 | — | 21.0 | 24.1 | 0.02 | 0.01 | — | 2.04 | 0.03 | 0.27 | — | 0.001 |
| 2 | 0.012 | 0.8 | 50.2 | 0.003 | 1.2 | — | 21.1 | 24.1 | 0.008 | 0.01 | — | 2.01 | 0.02 | 0.24 | — | 0.001 |
| 3 | 0.044 | 0.8 | 55.4 | 0.002 | 1.09 | 0.00 | 20.0 | 20.1 | 0.04 | 0.13 | 0.007 | 2.36 | 0.03 | 0.01 | 0.006 | 0.001 |
| 4 | 0.046 | 0.8 | 55.2 | 0.002 | 1.2 | 0.00 | 19.9 | 20.1 | 0.05 | 0.15 | 0.007 | 2.34 | 0.01 | 0.02 | 0.007 | 0.10 |
| 5 | 0.045 | 0.8 | 55.2 | 0.001 | 1.2 | 0.01 | 20.2 | 19.3 | 0.07 | 0.17 | 0.01 | 2.32 | 0.42 | 0.01 | 0.006 | 0.15 |
| 6 | 0.041 | 0.8 | 55.0 | 0.002 | 1.2 | 0.00 | 20.0 | 20.2 | 0.03 | 0.1 | 0.007 | 2.34 | 0.03 | 0.1 | 0.005 | 0.11 |
| 7 | 0.047 | 0.8 | 54.7 | 0.002 | 1.1 | 0.02 | 20.0 | 19.9 | 0.12 | 0.01 | 0.006 | 2.4 | 0.58 | 0.08 | 0.002 | 0.14 |
| 8 | 0.043 | 0.8 | 54.1 | 0.002 | 1.2 | 0.02 | 19.9 | 20.1 | 0.12 | 0.01 | 0.010 | 2.43 | 0.59 | 0.18 | 0.019 | 0.38 |
| 9 | 0.049 | 0.8 | 54.7 | 0.002 | 1.2 | 0.12 | 19.8 | 19.8 | 0.10 | 0.01 | 0.004 | 2.04 | 1.15 | 0.14 | 0.002 | 0.1 |
| 10 | 0.047 | 0.8 | 53.3 | 0.002 | 1.0 | 0.08 | 21.0 | 20.6 | 0.02 | 0.01 | 0.012 | 2.67 | 0.06 | 0.38 | 0.004 | 0.001 |
| 11 | 0.045 | 0.77 | 47.88 | 0.002 | 1.08 | 0.00 | 22.56 | 24.57 | 0.001 | 0.005 | 0.009 | 2.40 | 0.01 | 0.44 | 0.006 | 0.001 |
| 12 | 0.020 | 0.8 | 54.4 | 0.002 | 1.2 | 0.00 | 20.1 | 20.5 | 0.09 | 0.01 | 0.007 | 2.5 | 0.004 | 0.27 | 0.006 | 0.002 |
| 13 | 0.025 | 0.8 | 49.0 | 0.003 | 1.1 | 0.00 | 21.3 | 24.9 | 0.03 | 0.01 | 0.006 | 2.48 | 0.004 | 0.28 | 0.008 | 0.001 |
| 14 | 0.017 | 0.8 | 49.6 | 0.002 | 1.2 | 0.02 | 20.1 | 24.7 | 0.14 | 0.01 | 0.007 | 2.48 | 0.60 | 0.26 | 0.007 | 0.06 |
| 15 | 0.017 | 0.8 | 53.8 | 0.001 | 1.0 | 0.02 | 20.3 | 20.5 | 0.13 | 0.01 | 0.008 | 2.43 | 0.59 | 0.25 | 0.005 | 0.06 |
| 16 | 0.016 | 0.8 | 48.5 | 0.002 | 1.1 | 0.02 | 20.7 | 25.1 | 0.19 | 0.01 | 0.007 | 2.49 | 0.62 | 0.20 | 0.002 | 0.09 |
| 17 | 0.015 | 0.8 | 48.96 | 0.001 | 1.06 | 0.40 | 19.9 | 26.1 | 0.10 | 0.004 | 0.003 | 2.46 | 0.004 | 0.20 | 0.002 | 0.001 |
| 18 | 0.015 | 0.8 | 53.2 | 0.002 | 0.9 | — | 21.3 | 20.8 | 0.01 | 0.003 | — | 2.25 | 0.05 | 0.26 | — | 0.001 |
| 19 | 0.014 | 0.8 | 50.1 | 0.002 | 1.1 | 0.4 | 20.6 | 24.1 | 0.02 | 0.004 | 0.006 | 2.42 | 0.06 | 0.28 | — | 0.001 |
| INCOLOY ® 864 alloy (Control) | 0.048 | 0.39 | 39.0 | 0.001 | 0.83 | 0.09 | 33.4 | 20.5 | 0.23 | 0.81 | 0.001 | 4.59 | 0.04 | 0.01 | 0.01 | 0.001 |

Room temperature (25° C.) tensile properties, hardness, as-annealed grain size, and level of critical alloying elements for each sample tested are listed in Table 2. Further testing details are provided in the data tables and examples below. Average ASTM Grain Size number was determined according to E112-96 (2004) after applying a simulated brazing cycle thermal treatment at 2200° F. (1204° C.) for 20 min, air cooled, 2000° F. (1093° C.) for 3 hrs, and air cooled. Yield Strength (Ksi) and Tensile Strength (Ksi) were determined according to ASTM E8-04 using specimens of dimensions described in section 6.5.4.1.

TABLE 2

| Sample No. | C | Zr | N | Nb | Al | Cr | [1]Ann | ASTM GS | Y.S. Ksi | T. S. Ksi | % EL |
|---|---|---|---|---|---|---|---|---|---|---|---|
| 1 | 0.012 | 0.001 | 0.27 | 0.03 | 0.02 | 24.1 | 2000 F. | 6 | 50.3 | 107.5 | 49.1 |
| 3 | 0.044 | 0.001 | 0.01 | 0.03 | 0.04 | 20.1 | 1800 F. | 10 | 44.7 | 91.4 | 41.8 |
| " | | | | | | | 2000 F. | 6.5 | 31.3 | 81.7 | 49.8 |
| 4 | 0.046 | 0.10 | 0.02 | 0.01 | 0.05 | 20.1 | 1800 F. | 10.5 | 44.2 | 89.3 | 43.4 |
| " | | | | | | | 2000 F. | 6.5 | 32.2 | 83.2 | 48.0 |

TABLE 2-continued

| Sample No. | C | Zr | N | Nb | Al | Cr | [1]Ann | ASTM GS | Y.S. Ksi | T. S. Ksi | % EL |
|---|---|---|---|---|---|---|---|---|---|---|---|
| 5 | 0.045 | 0.15 | 0.01 | 0.42 | 0.07 | 19.3 | 1800 F. | 10.5 | 53.0 | 96.2 | 38.9 |
| " | | | | | | | 2000 F. | 7 | 31.9 | 83.1 | 45.2 |
| 6 | 0.041 | 0.11 | 0.10 | 0.03 | 0.03 | 20.2 | 1800 F. | 10.5 | 53.5 | 100.7 | 40.3 |
| " | | | | | | | 2000 F. | 7.5 | 42.5 | 94.7 | 43.0 |
| 7 | 0.047 | 0.14 | 0.08 | 0.58 | 0.12 | 19.9 | 1800 F. | 11.5 | 54.1 | 98.9 | 39.3 |
| " | | | | | | | 2000 F. | 8.5 | 40.9 | 93.7 | 40.8 |
| 8 | 0.043 | 0.38 | 0.18 | 0.59 | 0.12 | 20.1 | 1800 F. | 11.5 | 60.8 | 105.9 | 36.1 |
| " | | | | | | | 2000 F. | 8.5 | 48.1 | 102.1 | 39.0 |
| 9 | 0.049 | 0.1 | 0.14 | 1.15 | 0.10 | 19.8 | 1800 F. | 11.5 | 53.7 | 98.4 | 37.8 |
| " | | | | | | | 2000 F. | 8.5 | 42.3 | 94.1 | 40.8 |
| 10 | 0.047 | 0.001 | 0.38 | 0.06 | 0.02 | 20.6 | 1800 F. | 10 | 81.3 | 130.7 | 32.9 |
| " | | | | | | | 2000 F.[2] | 7 | 68.9 | 127.6 | 42.2 |
| 11 | 0.045 | 0.001 | 0.44 | 0.01 | 0.001 | 24.57 | 1800 F. | 9 | 85.2 | 135.6 | 33.3 |
| " | | | | | | | 2000 F. | 7 | 70.2 | 131.4 | 44.4 |
| 12 | 0.020 | 0.002 | 0.27 | 0.004 | 0.09 | 20.5 | 1800 F. | 11 | 66.0 | 116.5 | 38.8 |
| | | | | | | | 2000 F. | 8 | 55.0 | 111.3 | 43.3 |
| | | | | | | | CR50%[3] | | 157.1 | 183.5 | 4.5 |
| 13 | 0.025 | 0.001 | 0.28 | 0.004 | 0.03 | 24.9 | 1800 F. | 12 | 81.1 | 129.5 | 35.2 |
| | | | | | | | 2000 F. | 7 | 56.9 | 115.5 | 46.6 |
| | | | | | | | CR50% | | 159.7 | 193.5 | 5.1 |
| 14 | 0.017 | 0.06 | 0.26 | 0.60 | 0.14 | 24.7 | 1800 F. | | | | |
| | | | | | | | 2000 F.[2] | 12 | 60.0 | 114.4 | 34.4 |
| 15 | 0.017 | 0.06 | 0.25 | 0.59 | 0.13 | 20.5 | 1800 F. | | | | |
| | | | | | | | 2000 F.[2] | 11.5 | 54.1 | 107.8 | 36.4 |
| 16 | 0.016 | 0.09 | 0.20 | 0.62 | 0.19 | 25.1 | 1800 F. | | | | |
| | | | | | | | 2000 F.[2] | 12 | 72.6 | 117.6 | 27.4 |
| 17 | 0.015 | 0.001 | 0.20 | 0.004 | 0.10 | 26.1 | 2000 F. | 10 | 59.5 | 115.1 | 35.7 |
| 18 | 0.015 | 0.001 | 0.26 | 0.05 | 0.01 | 20.8 | 2000 F. | 6 | 51.4 | 108.6 | 45 |
| 19 | 0.014 | 0.001 | 0.28 | 0.06 | 0.02 | 24.1 | 2000 F. | 5.5 | 51 | 109.9 | 46.4 |
| Control | 0.048 | 0.001 | 0.01 | 0.04 | 0.23 | 20.5 | 2000 F. | 7 | 40.8 | 99.6 | 40.1 |

[1]Annealed at 1800° F. or 2000° F. for 5 minutes, then air cooled.
[2]Average of duplicates.
[3]Cold rolled 50%.

X-Ray Analysis

Figure 2:
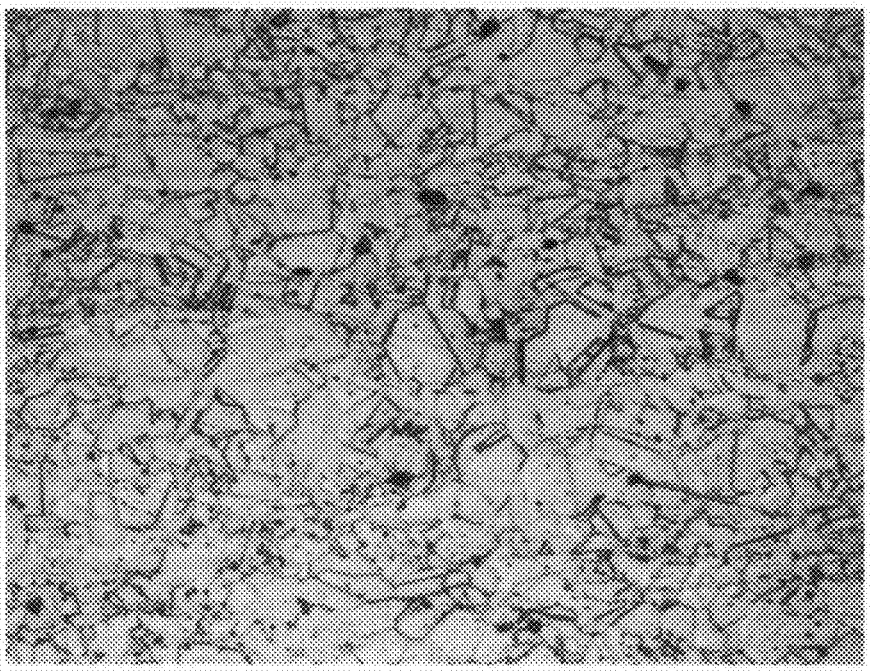
FIG. 2 is a photomicrograph of the Control alloy after 1800° F. annealing.
Figure 3:
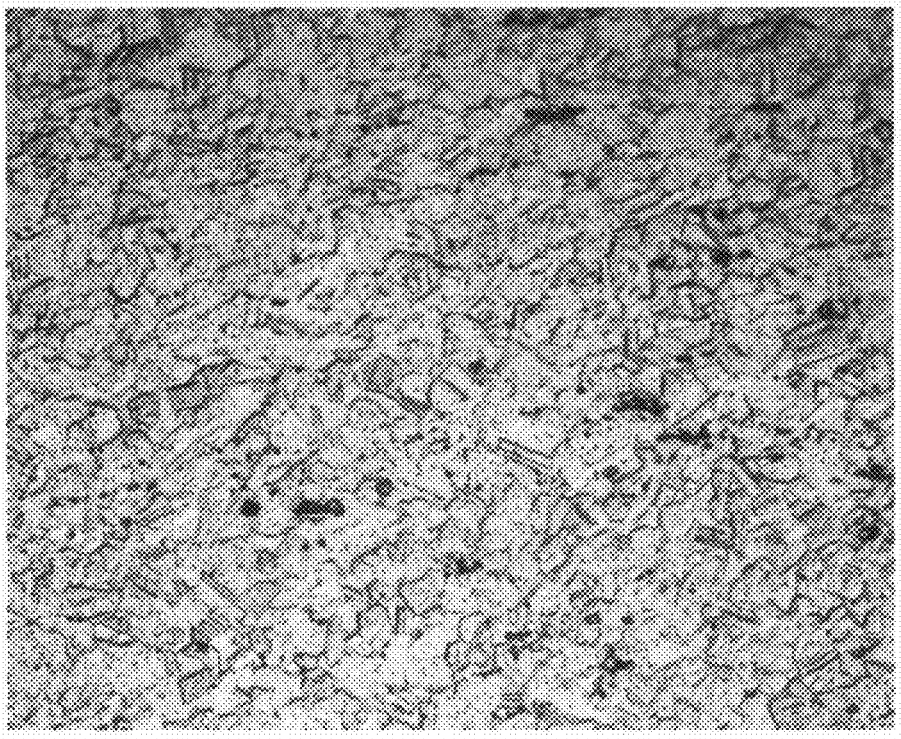
FIG. 3 is a photomicrograph of the alloy of Sample 7 after 1800° F. annealing, according to the present invention.
Figure 4:
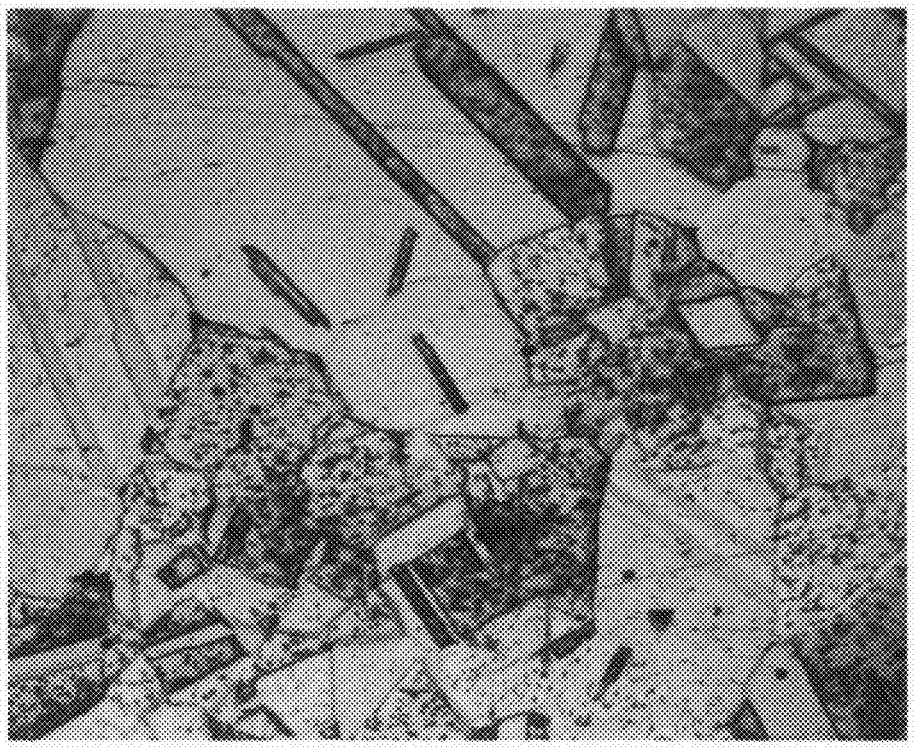
FIG. 4 is a photomicrograph of the Control alloy after 2000° F. annealing.
Figure 5:
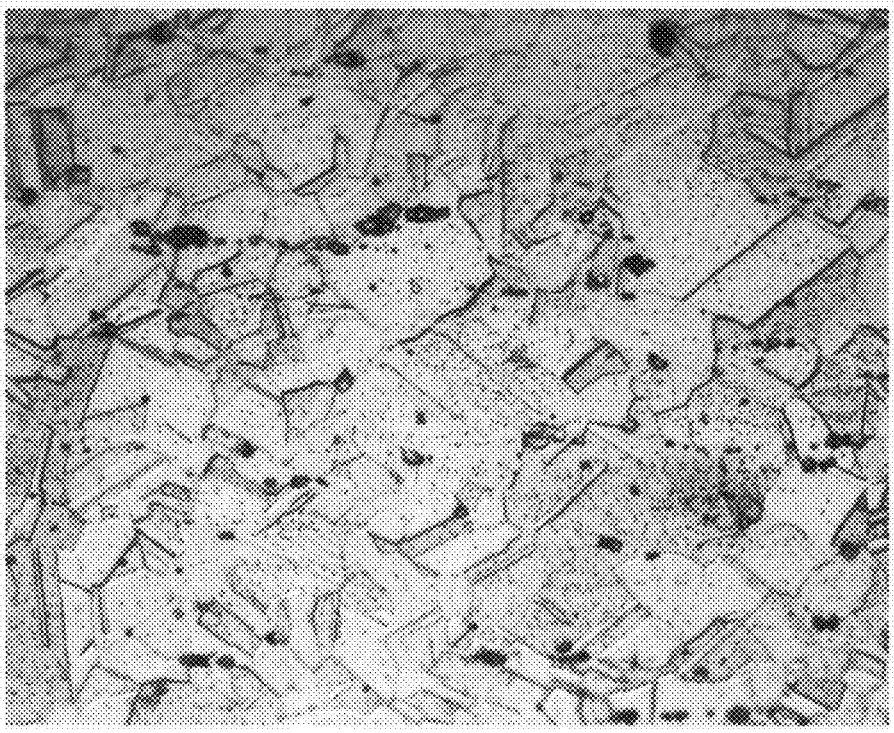
FIG. 5 is a photomicrograph of the alloy of Sample 7 after 2000° F. annealing, according to the present invention.

After extracting inclusions and the precipitated phases from each sample using an HCl-methanol electrolytic procedure (ASTM E-963), the resulting powder was analyzed using X-ray diffraction. All samples photographed for microstructure were etched in 2% bromine in methanol solution. The results are shown in FIGS. 2-5. FIG. 2 shows typical INCOLOY® 864 alloy that has been annealed at 1800° F. Very few fine nitrides are present and the main precipitates are carbides, which should have a solvus temperature below 2000° F. As shown in FIG. 3, for Sample 7 (containing 0.08% N, 0.58% Nb, 0.14% Zr, and 0.12% Al) niobium and zirconium nitrides were the only two major phases found, although AlN could have been present. The grain size is finer compared to the 864 material, as more fine precipitates prevent grain growth. FIG. 5 shows an acceptable level of precipitates to provide grain control while maintaining acceptable ductility compared to the Control sample shown in FIG. 4 which lacks grain size control.

Strength

Figure 6:
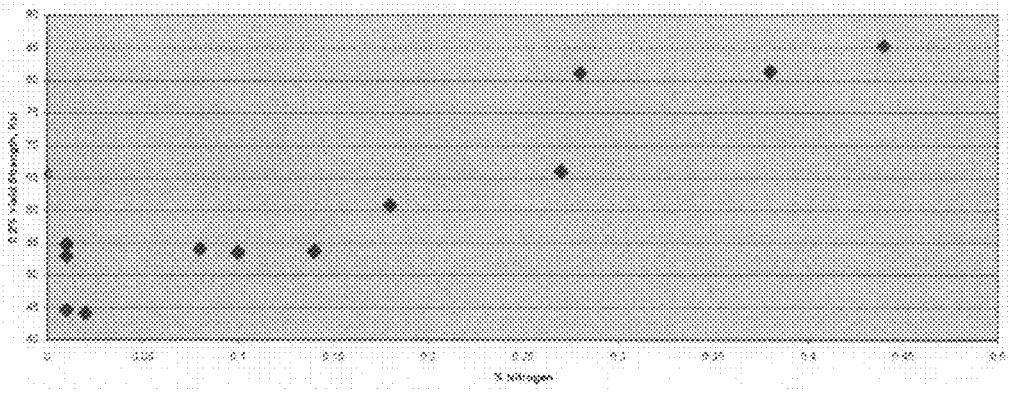
FIG. 6 is a graph of 0.2% yield strength as a function of percent nitrogen for test samples annealed at 1800° F.
Figure 7:
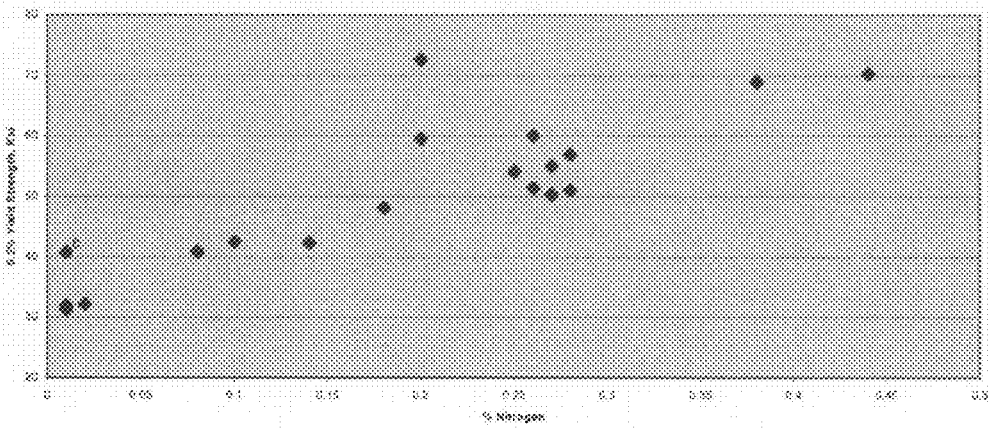
FIG. 7 is a graph of 0.2% yield strength as a function of percent nitrogen for test samples annealed at 2000° F.
Figure 8:
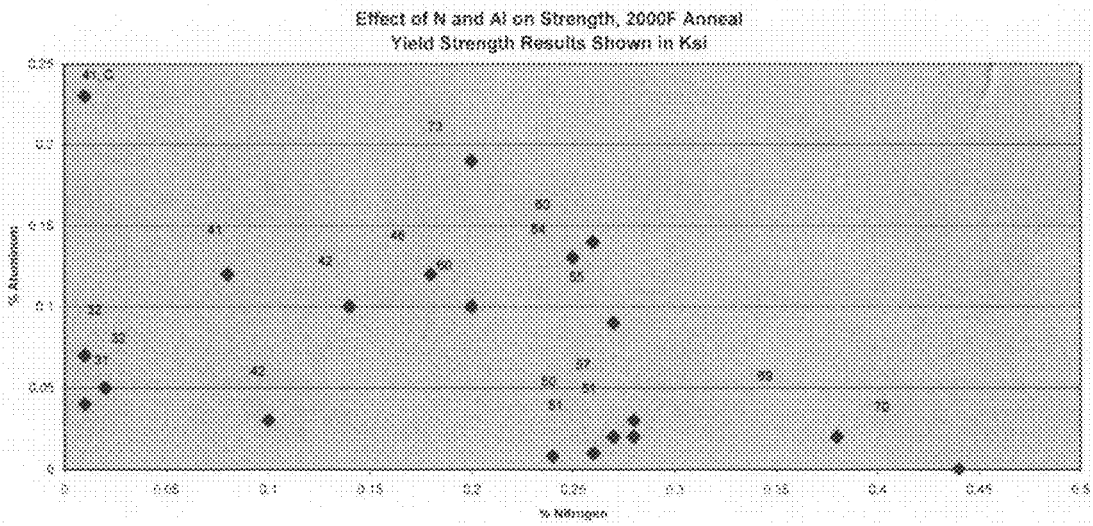
FIG. 8 is a graph showing the effect of concentration of nitrogen and aluminum on 0.2% yield strength for test samples annealed at 2000° F.

In the compositions studied, the main contributor to strength is nitrogen. This is illustrated in FIGS. 6 and 7 for alloy strip annealed at 1800° F. and 2000° F., respectively. With a nominal nitrogen content of 0.25%, yield strength levels of about 70 Ksi and 55 Ksi are obtained with 1800° F. and 2000° F. anneals. The strength levels corresponding to various aluminum and nitrogen ranges are shown for 2000° F. annealed materials in FIG. 8. At higher aluminum levels, above about 0.12%, aluminum nitride formation has an additional strengthening effect.

The 2000° F. annealed yield strength of alloy 864 and SS316 is about 35-40 Ksi. At moderate nitrogen levels the experimental alloy should easily attain 50-55 Ksi levels.

Ductility

Figure 9:
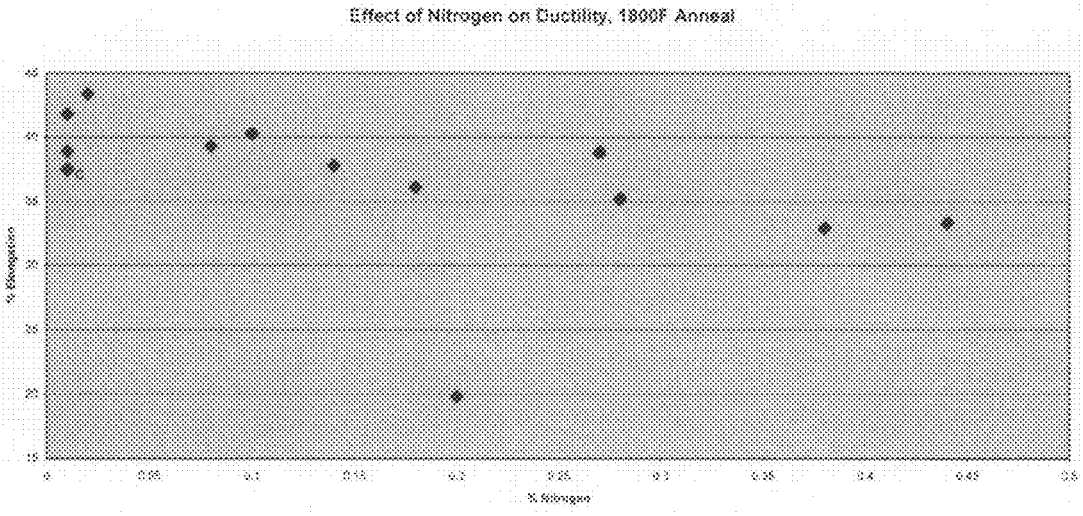
FIG. 9 is a graph showing the effect of concentration of nitrogen on ductility for test samples annealed at 1800° F.

In the 1800° F. annealed condition, where higher strengths are involved, ductility is also strongly affected by nitrogen content as shown in FIG. 9. As nitrogen increases strength, it also reduces ductility. After 2000° F. anneals, the main element controlling ductility is aluminum, FIG. 10. Again, aluminum nitride becomes more of a factor simply because the carbides present after the 1800° anneal have been dissolved. Aluminum nitride and other nitrides form in even low nitrogen heats. As the level of aluminum nitride increases, due to increasing aluminum, the ductility is slowly reduced. At lower aluminum levels the main nitrides are Zr and Nb nitrides, but they are not as effective as AlN in regard to strength. Below these levels the main effect may be the Ni/Cr ratio, as seen in FIG. 11.

Figure 12:
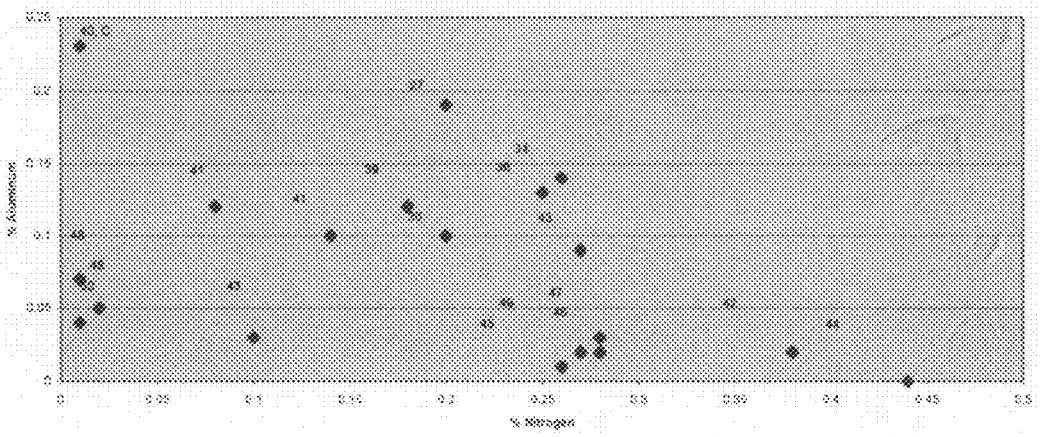
FIG. 12 is a graph showing the effect of nitrogen and aluminum on ductility for test samples annealed at 2000° F.

The ductility levels corresponding to various aluminum and nitrogen ranges are shown for 2000° F. annealed samples in FIG. 12, which shows that aluminum has a secondary effect at higher levels, greater than about 0.1%. To optimize ductility, a maximum of about 0.1% aluminum would be useful. With a higher chromium, or lower carbon plus niobium composition, the elongation should be greater than 45%.

The test results below are from longitudinal tensile tests. Sub size transverse tensile specimens were also tested to determine the effect of orientation on ductility. As shown in Table 3, 0.2% yield strength, tensile strength and elongation were comparable between Samples 6, 7 and 10 vs. the Control Sample.

TABLE 3

Comparison of Longitudinal and Transverse RTT Results
Longitudinal tests on T-9A (9" long), Transverse on 4" long sub size specimen
(Average 4.3% greater elongation in transverse direction)

| Sample No. | Anneal, ° F. for 5 Min, air cooled | Orientation | 0.2% Yield Strength, Ksi | Tensile Strength, Ksi | % Elongation | Increase of Elongation in Transverse Direction |
|---|---|---|---|---|---|---|
| 6 | 1800 | Longitudinal | 53.5 | 100.7 | 40.3 | |
| | | Transverse | 46 | 98 | 48.0 | 7.7 |
| | 2000 | Longitudinal | 42.5 | 94.7 | 43.0 | |
| | | Transverse | 41 | 92 | 50.4 | 7.4 |
| 7 | 1800 | Longitudinal | 54.1 | 98.9 | 39.3 | |
| | | Transverse | 56 | 99 | 41.8 | 2.5 |
| | 2000 | Longitudinal | 40.9 | 93.7 | 40.8 | |
| | | Transverse | 41 | 92 | 45.4 | 4.6 |
| 10 | 1800 | Longitudinal | 81.3 | 130.7 | 32.9 | |
| | | Transverse | 79 | 128 | 31.0 | −1.9 |
| Control | 1800 | Longitudinal | 54.8 | 105.8 | 37.5 | |
| | | Transverse | 56 | 103 | 43.0 | 5.5 |
| | 2000 | Longitudinal | 40.8 | 99.6 | 40.1 | |
| | | Transverse | 27 | 97 | 44.6 | 4.5 |

Grain Size

Grain size measured for INCOLOY® 864 alloy (Control) and Samples 3-17 are shown in Table 4 for the as-annealed and simulated brazing cycle heat treatments. The simulated brazing cycle thermal treatment used was 2200° F. (1204° C.) for 20 min, air cooled, 2000° F. (1093° C.) for 3 hrs, and air cooled.

TABLE 4

Effect of Simulated Brazing Cycle[1] on Grain Size
Strip Samples, 2000° F. for 5 min, air cooled, Anneal

| Run No. | C | Zr | N | Nb | Al | Cr | ASTM GS As-Anneal | ASTM GS After Braze* |
|---|---|---|---|---|---|---|---|---|
| Control | 0.048 | 0.001 | 0.01 | 0.04 | 0.23 | 20.5 | 6.5 | 0 |
| 3 | 0.044 | 0.001 | 0.01 | 0.03 | 0.04 | 20.1 | 6.5 | 4.5 |
| 4 | 0.046 | 0.10 | 0.02 | 0.01 | 0.05 | 20.1 | 6.5 | 4.5 |
| 5 | 0.045 | 0.15 | 0.01 | 0.42 | 0.07 | 19.3 | 7 | 4.5 |
| 6 | 0.041 | 0.11 | 0.10 | 0.03 | 0.03 | 20.2 | 7.5 | 5.5 |
| 7 | 0.047 | 0.14 | 0.08 | 0.58 | 0.12 | 19.9 | 8.5 | 5.0 |
| 8 | 0.043 | 0.38 | 0.18 | 0.59 | 0.12 | 20.1 | 8.5 | 5.5 |
| 9 | 0.049 | 0.1 | 0.14 | 1.15 | 0.10 | 19.8 | 8.5 | 6 |
| 10 | 0.047 | 0.001 | 0.38 | 0.06 | 0.02 | 20.6 | 7 | 5.5 |
| 11 | 0.045 | 0.001 | 0.44 | 0.01 | 0.001 | 24.57 | 7 | 3 |
| 12 | 0.020 | 0.002 | 0.27 | 0.004 | 0.09 | 20.5 | 8 | 6.0 |
| 13 | 0.025 | 0.001 | 0.28 | 0.004 | 0.03 | 24.9 | 7.0 | 4 |
| 14 | 0.017 | 0.06 | 0.26 | 0.60 | 0.14 | 24.7 | 12 | 7.5 |
| 15 | 0.017 | 0.06 | 0.25 | 0.59 | 0.13 | 20.5 | 11.5 | 7.5 |
| 16 | 0.016 | 0.09 | 0.20 | 0.62 | 0.19 | 25.1 | 12 | 7 |
| 17 | 0.015 | 0.001 | 0.20 | 0.004 | 0.10 | 26.1 | 10 | 5 |

*Anneal + 2200° F. for 20 min, air cooled, 2000 F. for 3 hr, air cooled

Figure 13:
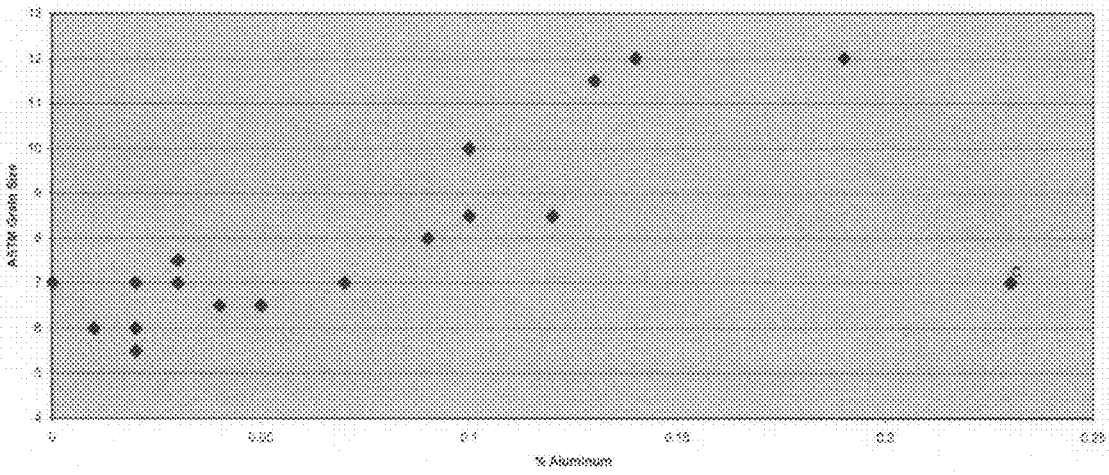
FIG. 13 is a graph showing the effect of aluminum on grain size for test samples annealed at 2000° F.
Figure 14:
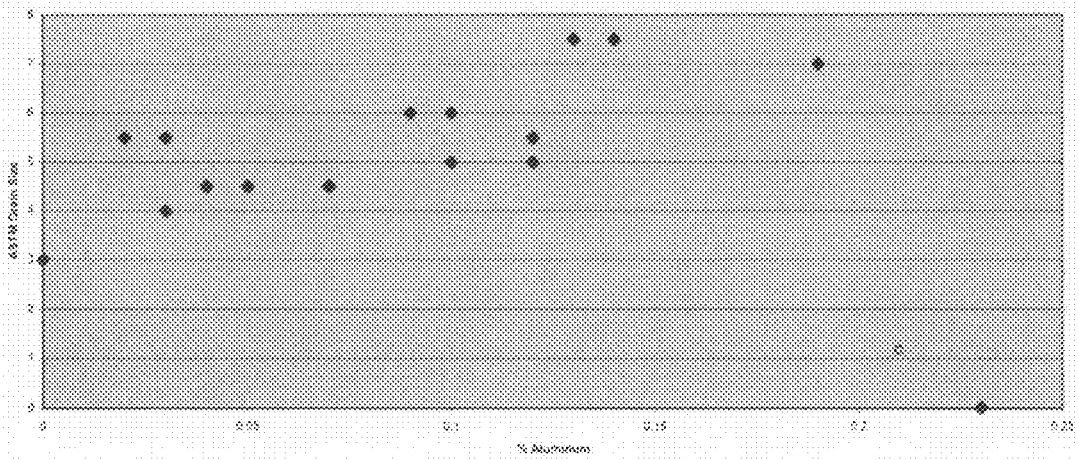
FIG. 14 is a graph showing the effect of aluminum on grain size for test samples after simulated brazing thermal cycle.
Figure 15:
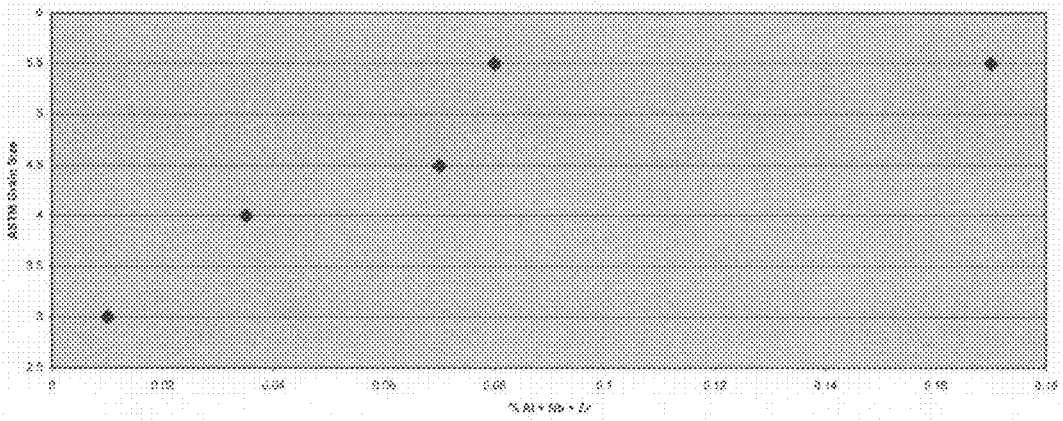
FIG. 15 is a graph showing the effect of aluminum, zirconium and niobium on grain size for test samples after simulated brazing thermal cycle.
Figure 16:
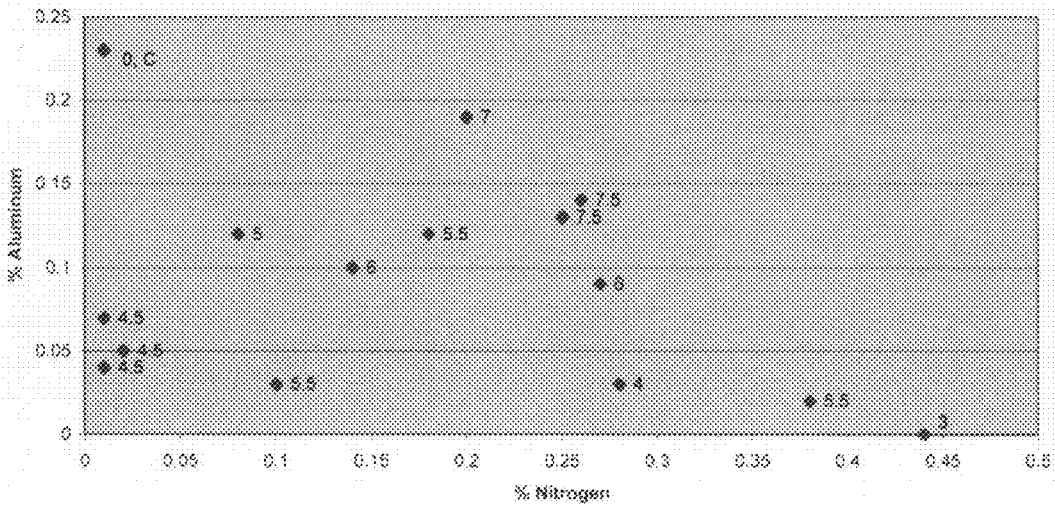
FIG. 16 is a graph showing the effect of nitrogen and aluminum on grain size for test samples after simulated brazing thermal cycle.

As shown in FIG. 13, increasing aluminum above about 0.05%, with resulting aluminum nitride formation, causes grain pinning and resulting finer grain size in the 2000° F. as-annealed condition. The same results were found for 1800° F. annealed strip. Aluminum has a similar effect of grain size after a simulated brazing heat treatment cycle, see FIG. 14. At lower aluminum levels, below about 0.05%, the grain size is determined by combined Al+Zr+Nb as shown in FIG. 15. At these low aluminum levels, niobium and zirconium nitrides have a noticeable effect on grain size, while at higher aluminum levels, aluminum nitride plays the dominant role.

Where grain size control is desired, a minimum nitrogen content is required for grain size control through nitride formation. The overall effect of aluminum and nitrogen on grain size after a simulated brazing cycle is shown in FIG. 16. At very low nitrogen levels, aluminum has no effect. Thus for good grain growth control by this method, aluminum should preferably be above about 0.08% and nitrogen should be above about 0.1%.

At low aluminum levels of less than 0.05%, niobium and zirconium also provide grains size control, FIG. 16, by precipitation of niobium and zirconium nitrides, FIG. 5.

In applications which require brazing, such as engineering coolers and honeycomb abradable seals, grain size control can be an issue. The alloys of the present invention can have acceptable grain size and can avoid cracking during brazing and possible lower than expected fatigue resistance. In actual practice and lab testing, alloy 864 can have a grain size number of ASTM 0 after brazing, in contrast to alloys of the present invention which can have a grain size number of 5 or more.

Several statistical regressions were performed on the mechanical tests to examine the actual significance of the various elements. Grain size was the largest indicator of ductility; aluminum (plus nitrogen) were the greatest contributors to grain size. Besides grain size, both zirconium and nitrogen affected ductility. Thus, aluminum, zirconium, and nitrogen were the elements with the most direct effect on elongation with each of them being negative. To control grain size, the nitrogen and aluminum were desirable, so a tradeoff was needed.

Fatigue Resistance

Figure 17:
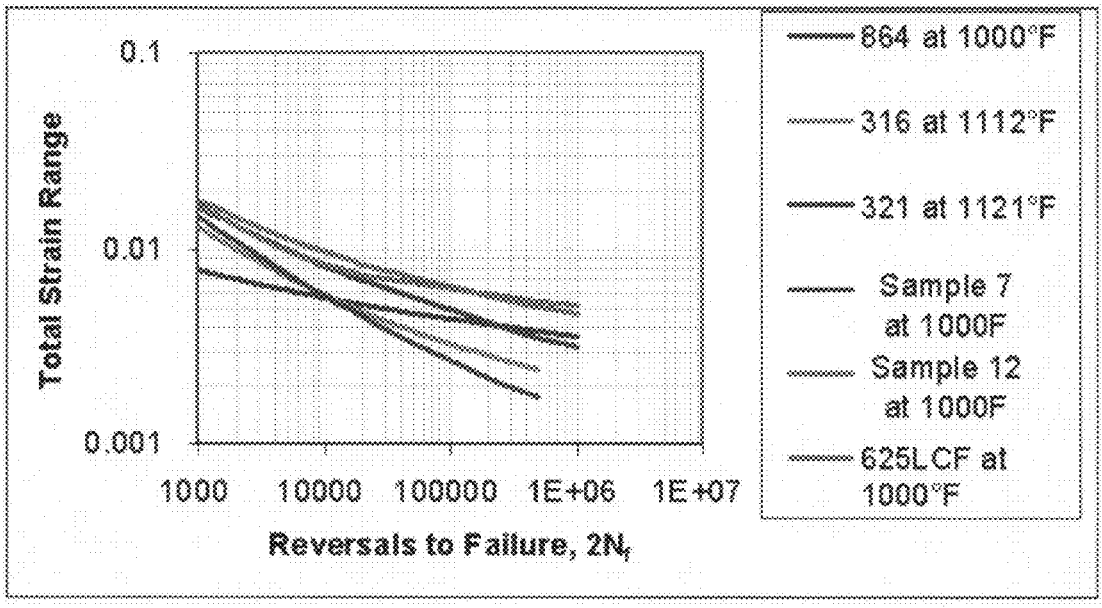
FIG. 17 is a graph of longitudinal strain controlled, high temperature fatigue test results.

Longitudinal strain controlled fatigue testing of samples was conducted according to ASTM E 606-92 (98) under the following conditions: longitudinal strain control, Extensometer length 0.375 inches, temperature of 1000° F. (538° C.), strain ratio R=−1.0, at a frequency of 0.5 Hz and triangle waveform using a closed loop servo-controlled hydraulic system of 20,000 lbs capacity. Results for Samples 7 and 12, in the 2000F annealed condition, are compared to commercial alloys 864, 316, 321 and 625LCF in FIG. 17. Sample 7, with a yield strength of 41 Ksi, is slightly superior to the stainless steel and INCOLOY® 864 alloy. With a 0.27% nitrogen content, Sample 12 had a yield strength of 55 Ksi and was significantly better than 316 and 864 and is comparable to alloy 625.

Oxidation Resistance

Figure 18:
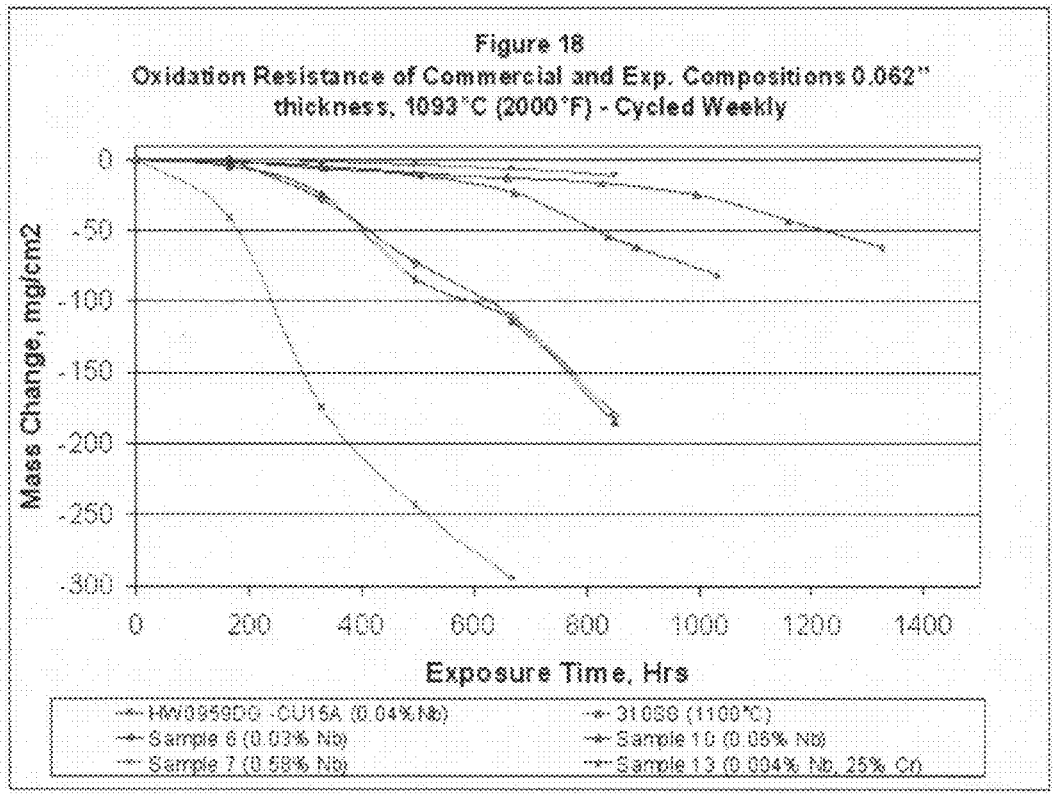
FIG. 18 is a graph of oxidation resistance test results.

Results for 2000° F. oxidation testing of the Control, stainless steel 310SS and Samples 6, 7, 10 and 13, cycled weekly, in 95% air plus 5% water vapor are presented in FIG. 18. Silicon provides improved oxidation resistance through the formation of silicates in the oxide layer. Niobium can be detrimental to oxidation resistance; however it has other benefits as discussed above. Sample 13 with high chromium and lower niobium has good oxidation resistance.

Stress Corrosion Cracking

Test samples 12, 13, and stainless steel 316, INCOLOY® 840 and 864 (Control) alloys were evaluated for boiling 45% magnesium chloride stress corrosion cracking (SCC) by immersion in boiling 45% magnesium chloride held at a constant boiling temperature of 155.0±1.0° C. for a period of 24 hours or more as measured according to ASTM Method G36-94 (2000) using samples prepared according to ASTM Method G30-97 (2003). Each sample was 1.5 mm (0.060") thick, 13 mm wide and 127 mm long. Time to crack is the time for SCC to become visible at 20×. Time to failure is the time required for cracking to advance to the extent that tension is lost in the legs of the U-bend specimen. Test results are shown in Table 5. Though all alloys tested experienced crack initiation within 5 hours, the crack propagation rates varied. Stainless steel 316 was the least resistant. Higher nickel INCOLOY® 840 alloy, a common heater sheet alloy, was more resistant. Sample 12 and 33% nickel alloy 864 were the most resistant.

TABLE 5

Boiling 45% Magnesium Chloride Stress Corrosion Cracking Test Results
U-bend Specimens, 0.060" Strip, 2000° F. Anneal

| Sample | Ni | Cr | Mo | Si | N | Al | Nb | Zr | Time to Crack, hr | Time to Fail, hr |
|---|---|---|---|---|---|---|---|---|---|---|
| 12 | 20.1 | 20.5 | 2.5 | 1.2 | 0.27 | 0.09 | 0.004 | 0.002 | 5 | 48 |
| 13 | 21.3 | 24.9 | 2.5 | 1.1 | 0.28 | 0.03 | 0.004 | 0.001 | 5 | 24 |
| Stainless Steel 316 | 10.4 | 16.4 | 2.1 | .35 | .03 | <.01 | — | — | 5 | 8 |
| INCOLOY ® 840 alloy | 18.5 | 19.9 | — | .6 | — | .4 | — | — | 5 | 24 |
| INCOLOY ® 864 alloy (Control) | 33.4 | 20.5 | 4.6 | .8 | .01 | .23 | .04 | .00 | 5 | 48 |

The present invention has been described with reference to specific details of particular embodiments thereof. It is not intended that such details be regarded as limitations upon the scope of the invention except insofar as and to the extent that they are included in the accompanying claims.

What is claimed is:

1. A corrosion resistant alloy consisting essentially of, in percent by weight:

(a) 18 to 24% Ni;
(b) 18 to 26% Cr;
(c) 1.5 to 3.5% Mo;
(d) 0.5 to 1.5% Si;
(e) 0.001 to 1.5% Nb;
(f) 0.0005 to 0.5% Zr;
(g) 0.1 to 0.6% N;
(h) 0.001 to 0.2% Al;
(j) less than 0.2% Ti;
(k) less than 1% Mn;
(l) 0.005-0.02% C; and
(m) up to 0.4% Cu;

trace impurities, and the balance Fe.

2. The corrosion resistant alloy according to claim 1, wherein the amount of Ni ranges from 20 to 24 weight percent.

3. The corrosion resistant alloy according to claim 1, wherein the amount of Ni is 20 weight percent.

4. The corrosion resistant alloy according to claim 1, wherein the amount of Cr ranges from 20 to 24 weight percent.

5. The corrosion resistant alloy according to claim 4, wherein the amount of Cr is 24 weight percent.

6. The corrosion resistant alloy according to claim 1, wherein the ratio of Ni to Cr is up to 0.8:1.

7. The corrosion resistant alloy according to claim 1, wherein the amount of Mo ranges from 2 to 3 weight percent.

8. The corrosion resistant alloy according to claim 7, wherein the amount of Mo is 2.2 weight percent.

9. The corrosion resistant alloy according to claim 1, wherein the amount of Si ranges from 0.5 to 1.2 weight percent.

10. The corrosion resistant alloy according to claim 9, wherein the amount of Si is 1.2 weight percent.

11. The corrosion resistant alloy according to claim 1, wherein the amount of Nb ranges from 0.001 to 0.5 weight percent.

12. The corrosion resistant alloy according to claim 11, wherein the amount of Nb is 0.02 weight percent.

13. The corrosion resistant alloy according to claim 1, wherein the amount of Zr ranges from 0.0005 to 0.2 weight percent.

14. The corrosion resistant alloy according to claim 13, wherein the amount of Zr is 0.001 weight percent.

15. The corrosion resistant alloy according to claim 1, wherein the amount of N ranges from 0.1 to 0.3 weight percent.

16. The corrosion resistant alloy according to claim 15, wherein the amount of N is 0.25 weight percent.

17. The corrosion resistant alloy according to claim 1, wherein the amount of C is 0.01 weight percent.

18. The corrosion resistant alloy according to claim 1, wherein the amount of Al ranges from 0.001 to 0.1 weight percent.

19. The corrosion resistant alloy according to claim 17, wherein the amount of Al is 0.01 weight percent.

20. The corrosion resistant alloy according to claim 1, wherein the amount of Ti ranges from zero to 0.05 weight percent.

21. The corrosion resistant alloy according to claim 19, wherein the amount of Ti is 0.01 weight percent.

22. The corrosion resistant alloy according to claim 1, wherein the alloy comprises less than 0.9 weight percent of Mn.

23. The corrosion resistant alloy according to claim 1, wherein the alloy comprises less than 0.05 weight percent of Mn.

24. The corrosion resistant alloy according to claim 1, wherein the alloy is essentially free of rare earth metals.

25. The corrosion resistant alloy according to claim 1, wherein the alloy comprises less than 0.05 weight percent of rare earth metals.

26. A corrosion resistant alloy, wherein the alloy consists essentially of, in percent by weight:

(a) 18 to 24% Ni;
(b) 18 to 26% Cr;
(c) 1.5 to 3.5% Mo;
(d) 0.5 to 1.5% Si;
(e) 0.001 to 1.5% Nb;
(f) 0.0005 to 0.5% Zr;
(g) 0.1 to 0.6% N;
(h) 0.005 to 0.05% C;
(i) 0.001 to 0.2% Al;
(j) zero to less than 0.2% Ti; and
(k) less than 1.0% Mn; and
(1) up to 0.4% Cu;
trace impurities, and the balance Fe.

27. A corrosion resistant alloy, wherein the alloy consists essentially of, in percent by weight:

(a) 20% Ni;
(b) 24% Cr;
(c) 2.2% Mo;
(d) 1.2% Si;
(e) 0.02% Nb;
(f) 0.001% Zr;
(g) 0.25% N;
(h) 0.01% C;
(i) 0.01% Al;
(j) 0.01% Ti; and
(k) less than 0.5% Mn,
trace impurities, and the balance Fe.

28. An article of manufacture prepared from the alloy of claim 1.

29. The article of manufacture according to claim 28, wherein the article is selected from the group consisting of bellows, wire braids, heater sheathes and heat exchangers.

30. An automotive flexible exhaust coupling made from a corrosion resistant alloy according to claim 1.

31. An automotive flexible exhaust coupling made from a corrosion resistant alloy according to claim 26.

32. The corrosion resistant alloy according to claim 1, wherein the alloy has a fatigue life at 1000° F. of 500,000 cycles, at total strain range of 0.005.

33. The corrosion resistant alloy according to claim 1, wherein the alloy resists stress corrosion cracking failure in boiling 45% magnesium chloride for a period of 24 hours or more.

34. The corrosion resistant alloy according to claim 1, wherein the alloy has an annealed yield strength of greater than 40 Ksi and a minimum elongation of greater than 34% measured at a temperature of 25° C.

35. The corrosion resistant alloy according to claim 34, wherein the yield strength of the alloy is 50 Ksi.

36. The corrosion resistant alloy according to claim 1, wherein the average ASTM grain size number is greater than 5.

37. The corrosion resistant alloy according to claim 1, wherein the weight percentage of aluminum is at least 0.08% and nitrogen is at least 0.1%.

38. The corrosion resistant alloy according to claim 1, wherein the weight percentage of aluminum is less than 0.05% and the sum of the weight percentages of aluminum, zirconium and niobium is at least 0.06%.

39. The corrosion resistant alloy according to claim 37, wherein the average ASTM grain size number is at least 8.

40. The corrosion resistant alloy according to claim 38, wherein the average ASTM grain size number is at least 8.

* * * * *

UNITED STATES PATENT AND TRADEMARK OFFICE

CERTIFICATE OF CORRECTION

PATENT NO. : 7,815,848 B2
APPLICATION NO. : 11/788931
DATED : October 19, 2010
INVENTOR(S) : Crum et al.

It is certified that error appears in the above-identified patent and that said Letters Patent is hereby corrected as shown below:

Column 15, line 28, Claim 26, "(j) zero to less than 0.2% Ti; and" should read
-- (j) less than 0.2% Ti; --

Signed and Sealed this
First Day of February, 2011

David J. Kappos

David J. Kappos
*Director of the United States Patent and Trademark Office*